US005638998A

United States Patent [19]

Thompson et al.

[11] Patent Number: 5,638,998

[45] Date of Patent: Jun. 17, 1997

[54] CUFF INSERTING APPARATUS

[75] Inventors: Ken J. Thompson, Lexington; John R. Everhart; Wayne G. Foster, both of Winston-Salem; Joel C. Rosenquist, Kernersville, all of N.C.

[73] Assignee: Sara Lee Corporation, Winston-Salem, N.C.

[21] Appl. No.: 505,798

[22] Filed: Jul. 21, 1995

[51] Int. Cl.[6] ..... A41H 43/00

[52] U.S. Cl. ..... 223/2; 223/1; 112/475.09; 112/470.14

[58] Field of Search ..... 223/37, 38, 3, 223/2, 1, 4; 112/475.09, 470.14

[56] References Cited

U.S. PATENT DOCUMENTS 3,779,185 12/1973 Sakakura et al. ..... 223/2

4,381,068 4/1983 Raisin et al. ..... 223/2

4,573,959 3/1986 Baccianti ..... 223/37 X 5,381,937 1/1995 Thompson et al. ..... 223/37

5,553,561 9/1996 Schramayer et al. ..... 112/470.14

*Primary Examiner*—Bibhu Mohanty

*Attorney, Agent, or Firm*—Rhodes Coats & Bennett, L.L.P.

[57] ABSTRACT

An apparatus for inserting a cuff into a sleeve of a garment. The apparatus includes a holding fixture for holding the cuff in a generally open configuration. A sleeve opener opens the sleeve of a garment sufficient to allow insertion of the cuff into the sleeve. The sleeve opener includes a support surface for supporting the sleeve and a pick-up head for engaging an upper layer of the sleeve. The pick-up head is mounted for vertical movement relative to the support surface to lift the upper layer of the sleeve and includes means for effecting relative movement between the holding fixture and the sleeve opener to insert the cuff into the sleeve.

14 Claims, 4 Drawing Sheets

CUFF INSERTING APPARATUS

BACKGROUND OF THE INVENTION (1) Field of the Invention

The present invention relates generally to automated manufacturing systems and, more particularly, to an apparatus for automatically setting a cuff for a sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, cuffs for sleeves and pant legs for sweat suits or the like must be manually placed to set the cuff. This has always been a manual operation because of the dexterity required to position the cuff properly prior to sewing. Unfortunately, repetitive actions such as setting a cuff to a garment may cause health problems. However, it has been extremely difficult to design a device which can reliably position the cuff time after time.

Thus, there remains a need for an apparatus for automatically setting a cuff for a sleeve or pant leg for a sweat suit or the like which will operate reliably time after time while, at the same time, can be carried out completely automatically without the need for a skilled operator.

SUMMARY OF THE INVENTION

The present invention is directed to an apparatus for inserting a cuff into a sleeve of a garment. The apparatus includes a holding fixture for holding the cuff in a generally open configuration. A sleeve opener opens the sleeve of a garment sufficient to allow insertion of the cuff into the sleeve.

The sleeve opener includes a support surface for supporting the sleeve and a pick-up head for engaging an upper layer of the sleeve. In the preferred embodiment, the support surface includes a plurality of vacuum ports connected to a vacuum source for holding a lower layer of the sleeve against the support surface.

Also in the preferred embodiment, the pick-up head includes a frame mounted for vertical movement between a raised position and a lowered position and at least one pair of opposed fabric pinchers extending downwardly from the frame. Each fabric pincher includes a contact surface for engaging the fabric layer when the frame is moved to a lowered position and a gripping surface opposed by the gripping surface of the opposing pincher. An actuating means moves the fabric pinchers between an open position in which an unobstructed open space is formed between the opposed gripping surfaces of the fabric pinchers and a closed position in which the fabric layer is clamped between the opposed gripping surfaces.

Further, in the preferred embodiment, the contact surface of the fabric pinchers is textured to provide a non-penetrating engagement with the fabric layer so that a fold is produced in the fabric layer when the fabric pinchers are moved to the closed position which extends into the open space between the pinchers and wherein the fold in the fabric layer is gripped between the opposed gripping surfaces.

The pick-up head is mounted for vertical movement relative to the support surface to lift the upper layer of the sleeve and the invention includes means for effecting relative movement between the holding fixture and the sleeve opener to insert the cuff into the sleeve.

Accordingly, one aspect of the present invention is to provide an apparatus for inserting a cuff into a sleeve of a garment. The apparatus includes: (a) a holding fixture for holding the cuff in a generally open configuration; (b) a sleeve opener for opening the sleeve of a garment sufficient to allow insertion of the cuff into the sleeve, the sleeve opener including a support surface for supporting the sleeve and a pick-up head for engaging an upper layer of the sleeve, wherein the pick-up head is mounted for vertical movement relative to the support surface to lift the upper layer of the sleeve; and (c) means for effecting relative movement between the holding fixture and the sleeve opener to insert the cuff into the sleeve.

Another aspect of the present invention is to provide a pick-up head for picking up a layer of fabric. The apparatus includes: (a) a frame mounted for vertical movement between a raised position and a lowered position; (b) at least one pair of opposed fabric pinchers extending downwardly from the frame, each fabric pincher including a contact surface for engaging the fabric layer when the frame is moved to a lowered position and a gripping surface opposed by the gripping surface of the opposing pincher; and (c) actuating means for moving the fabric pinchers between an open position in which an unobstructed open space is formed between the opposed gripping surfaces of the fabric pinchers and a closed position in which the fabric layer is clamped between the opposed gripping surfaces, wherein the contact surface of the fabric pinchers is textured to provide a non-penetrating engagement with the fabric layer so that a fold is produced in the fabric layer when the fabric pinchers are moved to the closed position which extends into the open space between the pinchers, and wherein the fold in the fabric layer is gripped between the opposed gripping surfaces.

Still another aspect of the present invention is to provide an apparatus for inserting a cuff into a sleeve of a garment. The apparatus includes: (a) a holding fixture for holding the cuff in a generally open configuration; (b) a sleeve opener for opening the sleeve of a garment sufficient to allow insertion of the cuff into the sleeve, the sleeve opener including a support surface for supporting the sleeve, the support surface including a plurality of vacuum ports connected to a vacuum source for holding a lower layer of the sleeve against the support surface and a pick-up head for engaging an upper layer of the sleeve, the pick-up head including: (i) a frame mounted for vertical movement between a raised position and a lowered position; (ii) at least one pair of opposed fabric pinchers extending downwardly from the frame, each fabric pincher including a contact surface for engaging the fabric layer when the frame is moved to a lowered position and a gripping surface opposed by the gripping surface of the opposing pincher; and (iii) actuating means for moving the fabric pinchers between an open position in which an unobstructed open space is formed between the opposed gripping surfaces of the fabric pinchers and a closed position in which the fabric layer is clamped between the opposed gripping surfaces; and wherein the contact surface of the fabric pinchers is textured to provide a non-penetrating engagement with the fabric layer so that a fold is produced in the fabric layer when the fabric pinchers are moved to the closed position which extends into the open space between the pinchers and wherein the fold in the fabric layer is gripped between the opposed gripping surfaces wherein the pick-up head is mounted for vertical movement relative to the support surface to lift the upper layer of the sleeve; and (c) means for effecting relative movement between the holding fixture and the sleeve opener to insert the cuff into the sleeve.

These and other aspects of the present invention will become apparent to those skilled in the art after a reading of the following description of the preferred embodiment when considered with the drawings.

DESCRIPTION OF THE PREFERRED EMBODIMENTS

Figure 1:
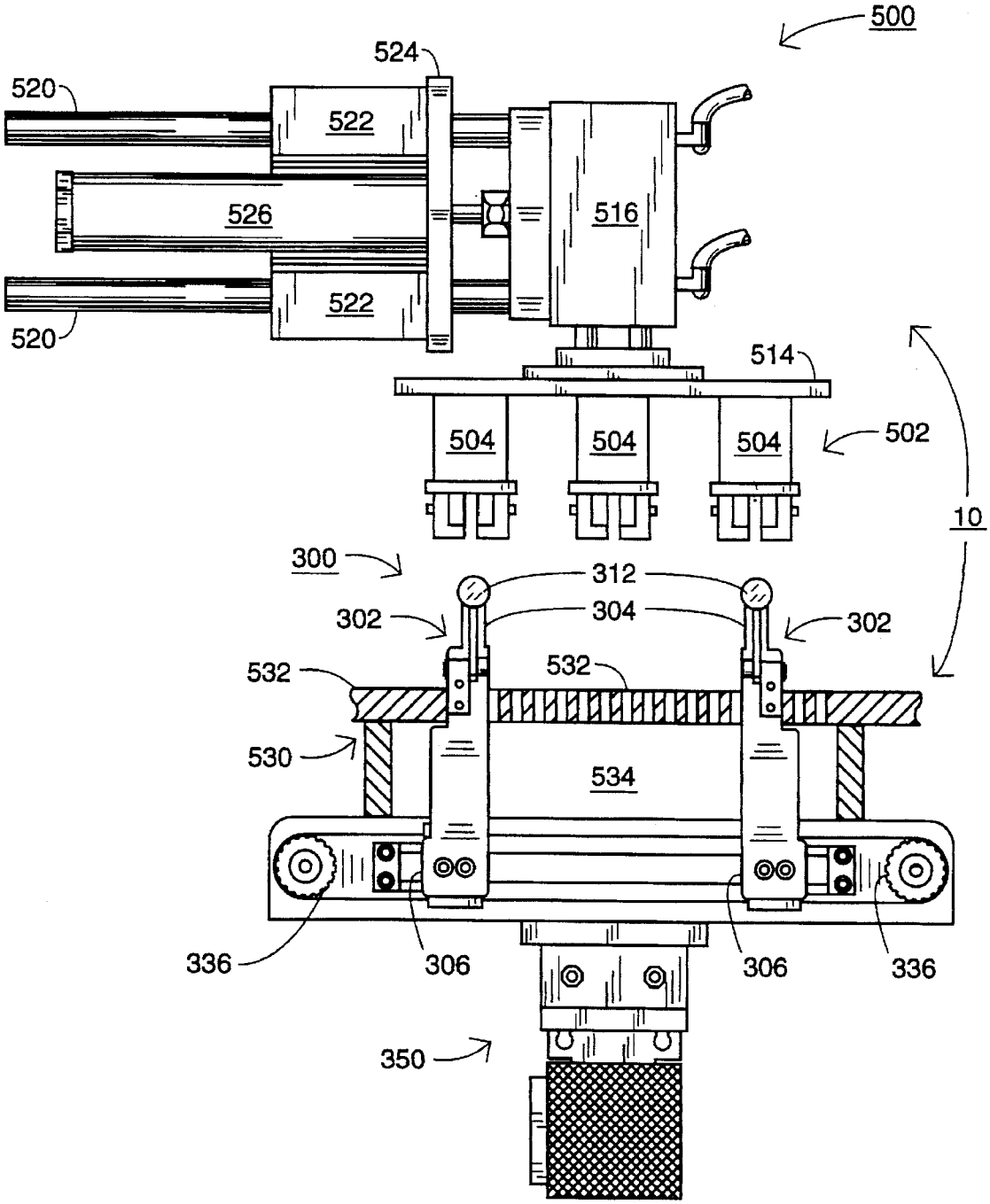
FIG. 1 is a front elevation view of a cuff inserter constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a cuff inserting apparatus, generally designated 10, is shown constructed according to the present invention. The cuff inserting apparatus is designed to insert a cuff into the sleeve of a garment so that the cuff can be sewn to the sleeve. The apparatus of the present invention could also be used to insert waistbands and collars into the body of a garment.

The cuff inserting apparatus 10 includes a cuff holding fixture 300 for holding the cuff and a sleeve opener 500 for opening the sleeve of the garment to allow insertion of the cuff into the sleeve. The holding fixture 300 is movably mounted so that when the sleeve of the garment is opened, the holding fixture 300 moves forwardly relative to the sleeve opener 500 to insert the cuff into the sleeve. These sub-systems are described in more detail below.

Holding Fixture

Figure 2:
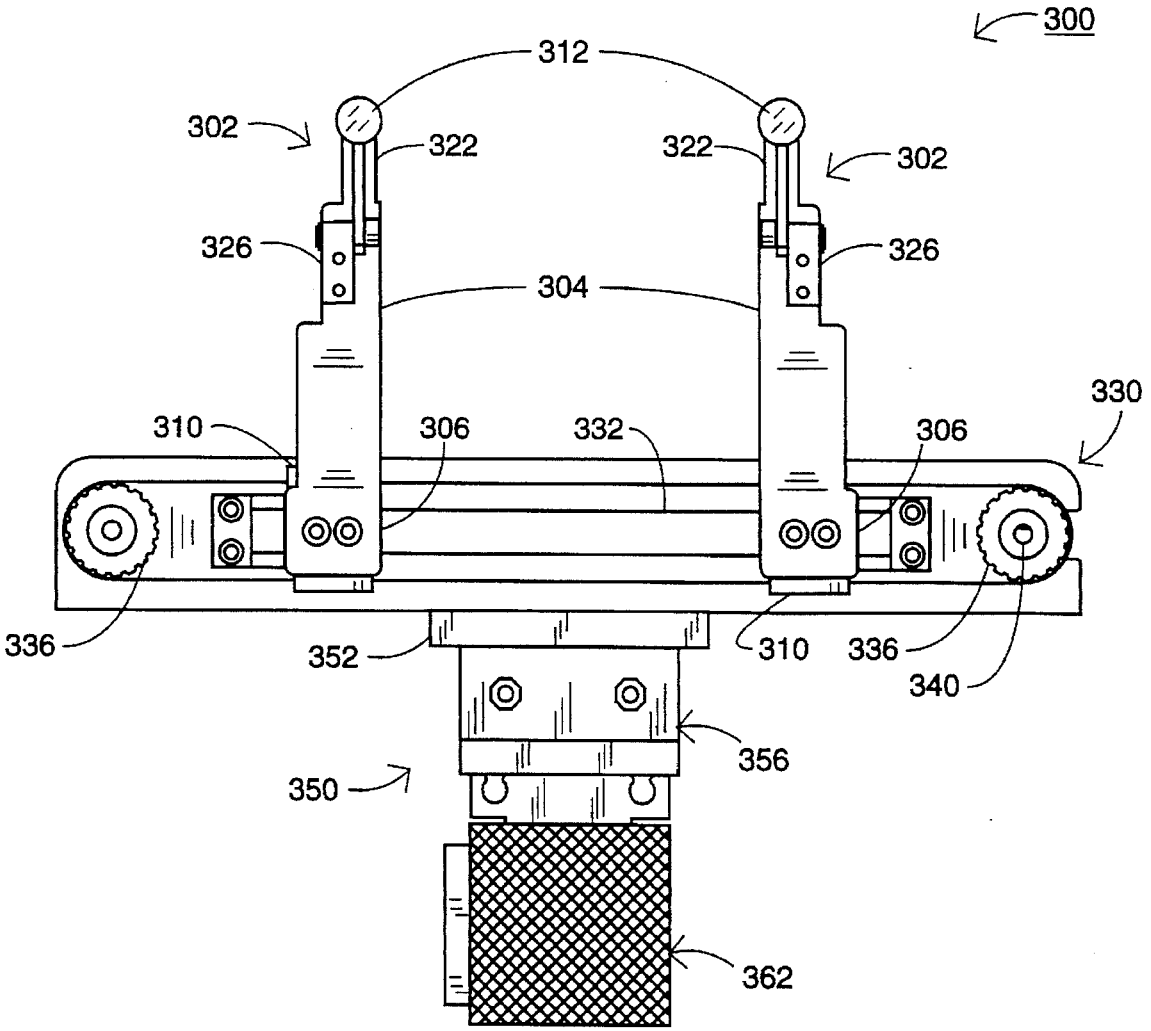
FIG. 2 is a front elevation view of the holding fixture for the cuff inserter.
Figure 3:
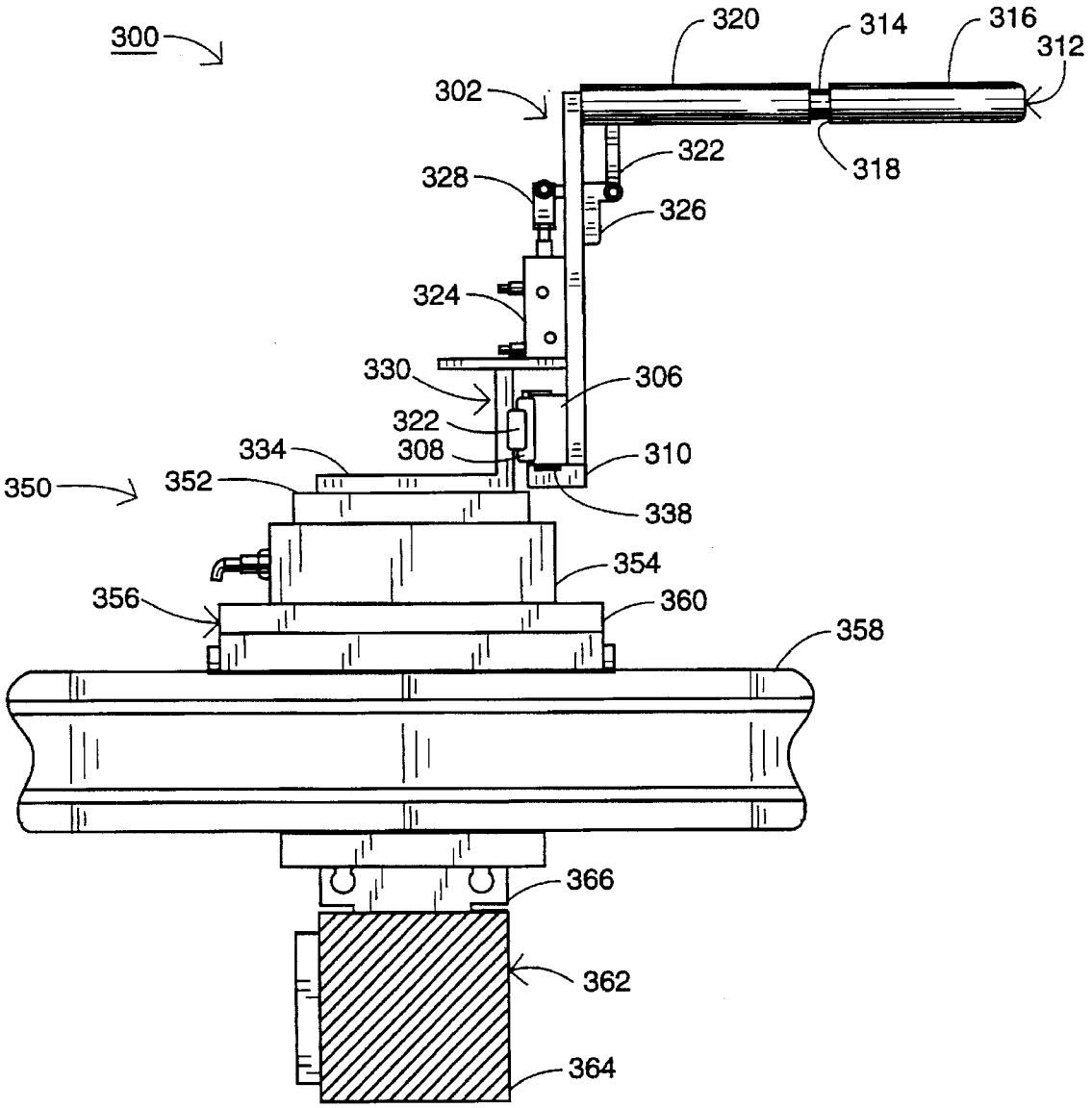
FIG. 3 is a side elevation view of the holding fixture.
Figure 4:
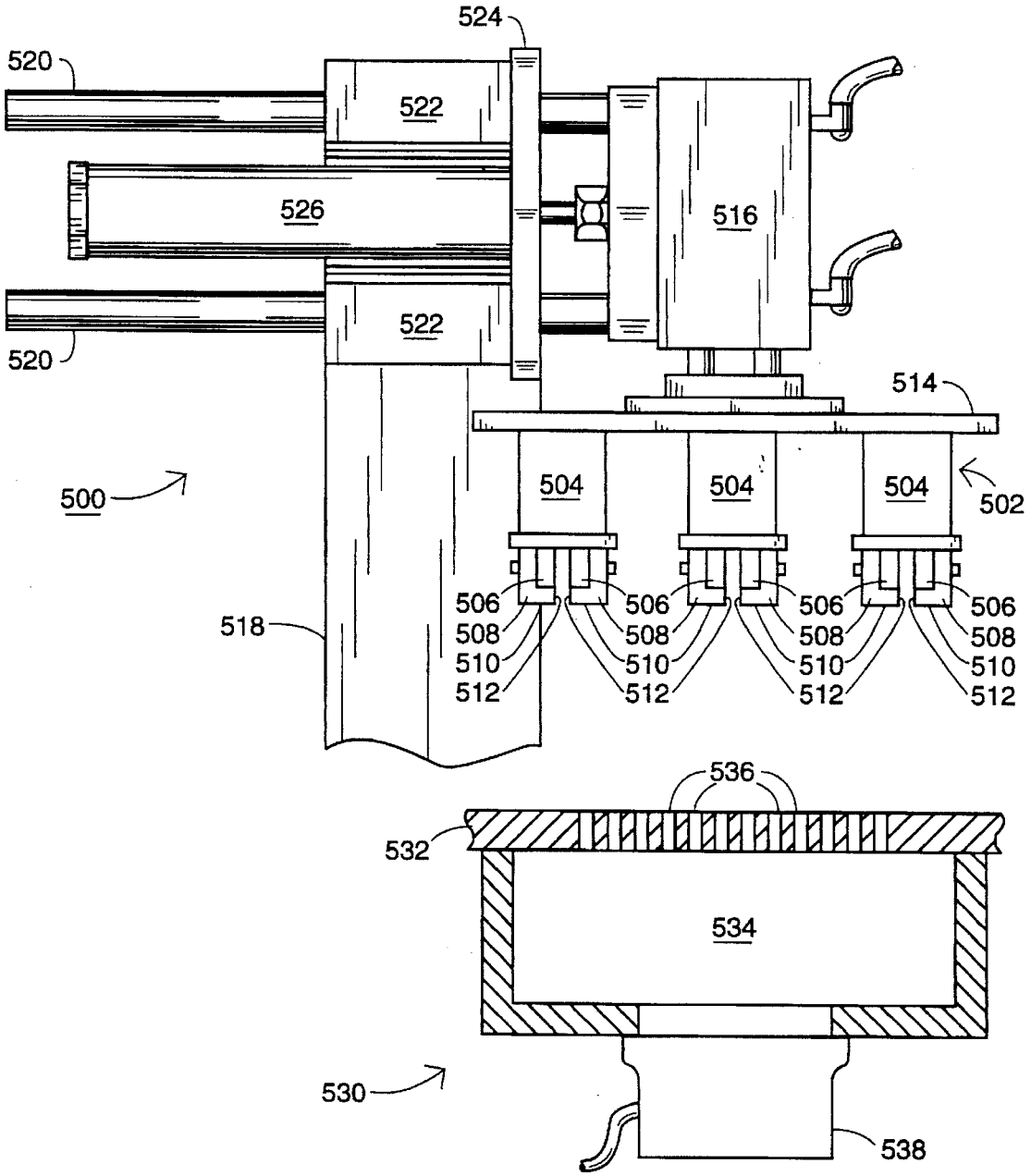
FIG. 4 is a side elevation view of the sleeve opener assembly.

The holding fixture 300, shown in FIGS. 2 and 3, includes a pair of band holders 302 which are movable relative to one another by a band holder drive assembly 330. The band holder drive assembly 330 is, in turn, mounted on a positioner 350 which is used to position the holding fixture 300.

Each band holder 302 includes a support post 304 having a clamping block 306 secured to the lower end thereof. A support finger 312 projects outwardly from the upper end of the support post 304. The support finger 312 includes first and second portions 314 and 316. The second portion 316 has a larger diameter than the first portion 314 so that a shoulder 318 is formed between the first and second portions 314 and 316.

A finger sleeve 320 is slidably mounted on the first portion 314 of the support finger 312. The finger sleeve 300 is movable between a closed position in which one end of the finger sleeve 320 is pressed against the shoulder 318, and an open position in which the finger sleeve 320 is spaced from the shoulder 318.

The finger sleeve 320 is movable between the open position and the closed position by a cylinder 324. The cylinder 324 is mounted to the support post 304. Cylinder 324 is connected to a yoke 328. A linkage 322, which is pivotally mounted on a link support 326, connects the finger sleeve 320 to the yoke 328. Thus, the actuation of the cylinder 324 causes the finger sleeve 320 to move back and forth between the open position and the closed position.

The band holder drive assembly 330 moves the band holders 302 relative to one another in a transverse direction. A pair of spaced-apart belt pulleys 336 are rotatably mounted to a frame member 334. A drive belt 338 is entrained around the belt pulleys 336. One of the belt pulleys 338 is driven by a belt motor 340. Belt motor 340 is preferably a servo-motor under the control of a programmable controller.

Each of the band holders 302 are clamped to the drive belt 338. The clamping block 306 of the band holder 302 includes a clamping member 310 which compresses the drive belt 338 between the clamping member 310 and clamping block 306. The clamping block 306 includes a guide channel 308 which engages with a track 332 on the frame member 334 to guide the movement of the band holder 302. Each of the band holders 302 is clamped to a respective run of the drive belt 338. One of the band holders 302 is clamped to a lower run of the drive belt 338, while the opposite band holder 302 is clamped to the upper run of the drive belt 338. Thus, the band holders 302 move in opposite directions relative to one another.

The holding fixture 300 is mounted on a positioner 350 which moves the holding fixture 300 in two directions and rotates the holding fixture 300. The positioner 350 includes a turntable 352 which is connected to a rotary actuator 354. The turntable 352 and rotary actuator 354 allow the holding fixture 300 to be rotated.

The turntable 352 and rotary actuator 354 are mounted to a linear slide 356. Linear slide 356 moves the holding fixture 300 along a first axis. Linear slide 356 includes a track 358 and a slide member 360. The rotary actuator 354 is mounted on the slide member 360.

Linear slide 356 is mounted on a second linear slide 362. Linear slide 362 allows the holding fixture 300 to be moved along a second axis which is perpendicular to the first axis. Linear slide 362 includes a track 364 and a slide member 366. Slide member 366 supports the track 358 of the first linear slide 356.

Sleeve Opener

The sleeve opener 500 includes a series of pick-up heads 502 for picking up the upper layer of a flattened sleeve and a vacuum table 530. In the preferred embodiment, three pick-up heads 502 are used. Each pick-up head 502 includes an actuator 504 having movable elements 506. L-shaped pinchers 508 are secured to the movable elements 508 of the actuator 504. Each pincher includes a contact surface 510 and a gripping surface 512. The contact surface 510 of the pinchers 508 are textured so as to provide non-penetrating engagement with the sleeve material when the pick-up head 502 is lowered into contact with the sleeve. Various methods for texturing the contact surface 510 can be used. The preferred method is to embed industrial diamonds into the contact surface 510. The embedded diamonds mechanically interlock with the knitted fabric without penetrating the fabric.

The pick-up heads 502 are mounted for both vertical and lateral movement. The pick-up heads 502 depend downwardly from a frame member 514. The frame member 514 is connected to a cylinder 516 which is operative to raise and lower the frame member 514. Cylinder 516 is mounted to a second frame member 518. A pair of guide rods 520 extend outwardly from frame member 518. The guide rods 520 are slidably received in a support block 522. Support block 522 is supported by frame member 524. A cylinder 526, which is also supported by frame member 524, is operative to move the pick-up heads 502 laterally.

The sleeve opener 500 also includes a vacuum table 530 for holding the lower layer of the sleeve in fixed position while the pick-up heads 502 engage and lift the upper layer of the sleeve. The vacuum table 530 includes a generally horizontal support surface 532. A vacuum chamber 534 is formed below the support surface 532. A series of vacuum ports 536 extend through the support surface 532. A vacuum pump is communicatively connected to the vacuum chamber 534 to apply a vacuum to the chamber 534. When the vacuum is applied, the lower layer of the sleeve is held by the vacuum against the support surface 532. While the lower layer is held by the vacuum, the pick-up heads 502 engage and lift the upper layer of the sleeve to open the sleeve. While the sleeve is held in the open position, the cuff can be inserted into the sleeve.

Operation

In operation, the cuff is loaded onto the holding fixture 300. The cuff can be manually loaded onto the holding fixture 300 or, alternately, can be loaded by automated means. The cuff material is pinched between the finger sleeve 320 and the shoulder 318 of the support finger 312 to prevent the cuff from slipping on the holding fixture. The sleeve is positioned over the vacuum table 350 and the vacuum pump 538 is actuated to apply vacuum to the vacuum chamber 534. When vacuum is applied to the vacuum chamber 534, the sleeve is held against the surface 532 of the vacuum table 530.

While the sleeve is held in place on the vacuum table 530, cylinder 526 is actuated to extend the pick-up heads 502. When the pick-up heads are positioned above the sleeve, cylinder 516 is then actuated to lower the pick-up heads 502 into engagement with the sleeve. The pick-up heads 502 are lowered until the contact surface 510 of the pinchers 508 engage the upper layer of the sleeve material and press the material against the vacuum table 530. Once the pick-up heads 502 are engaged with the upper layer of the sleeve, the actuators 504 are energized to close the pinchers 508. As the pinchers 508 move toward one another, a fold in the sleeve material is produced by the movement of the pinchers toward each other while pressed against the upper layer of the sleeve that extends between the gripping surfaces 512 of the opposed pinchers 508. Thus, the sleeve material is clamped between the opposed gripping surfaces 512 of the pinchers 508. Cylinder 516 is then actuated to raise the pick-up heads 502 while continuing to supply vacuum to the vacuum chamber 534. Thus, the sleeve is opened to allow insertion of the cuff by the combination of the upward movement of the pinchers holding the upper layer of the sleeve and the vacuum table holding down the lower layer of the sleeve.

When the sleeve is in an open position, the holding fixture 300 is moved forwardly relative to the sleeve opener 500 to insert the cuff into the sleeve. After the cuff is inserted into the sleeve, the sleeve and cuff can be transported to a sewing apparatus where they can be sewn together.

Certain modifications and improvements will occur to those skilled in the art upon a reading of the foregoing description. By way of example, the bottom layer of the sleeve may be held in position electrostatically or a renewable low tack adhesive, such as a tape, that is indexed each cycle. Also, is some applications, such as two layers of material in a vertical position, two opposing heads could be used if the pinchers are off-set slightly so that the gaps are not aligned. It should be understood that all such modifications and improvements have been deleted herein for the sake of conciseness and readability but are properly within the scope of the following claims.

We claim:

1. An apparatus for inserting a cuff into a sleeve of a garment, said apparatus comprising:

(a) a holding fixture for positioning the cuff in a generally open configuration;

(b) a sleeve opener for opening the sleeve of a garment sufficient to allow insertion of the cuff into the sleeve, said sleeve opener including a support surface with means for holding a lower edge of the sleeve against said support surface, and a pick-up head for engaging an upper layer of said sleeve, wherein said pick-up head is mounted for vertical movement relative to said support surface to lift the upper layer of said sleeve; and (c) means for effecting relative movement between said holding fixture and said sleeve opener to insert the cuff into the sleeve.

2. The apparatus according to claim 1, wherein said support surface further includes a plurality of vacuum ports connected to a vacuum source for holding a lower layer of said sleeve against said support surface.

3. The apparatus according to claim 1, wherein said holding fixture includes a pair of support fingers insertable into the cuff for positioning the cuff in a generally open configuration.

4. The apparatus according to claim 3, wherein said support fingers are movable relative to one another between a closed position to facilitate insertion of said fingers into the cuff and an open position to spread open the cuff.

5. The apparatus according to claim 4, wherein said support fingers include gripping means for gripping the cuff to hold said cuff on said support fingers.

6. The apparatus according to claim 5, wherein said gripping means comprises first and second cylindrical portions movable relative to one another between an open position in which an open space is formed between said first and second cylindrical portions, and a closed position in which the cuff is clamped between said first and second cylindrical portions.

7. An apparatus for inserting a cuff into a sleeve of a garment, said apparatus comprising:

(a) a holding fixture for positioning the cuff in a generally open configuration;

(b) a sleeve opener for opening the sleeve of a garment sufficient to allow insertion of the cuff into the sleeve, said sleeve opener including a support surface for supporting said sleeve, said support surface including a plurality of vacuum ports connected to a vacuum source for holding a lower layer of said sleeve against said support surface and a pick-up head for engaging an upper layer of said sleeve, said pick-up head including: (i) a frame mounted for vertical movement between a raised position and a lowered position; (ii) at least one pair of opposed fabric pinchers extending downwardly from said frame, each fabric pincher including a contact surface for engaging the fabric layer when said frame is moved to a lowered position and a gripping surface opposed by the gripping surface of said opposing pincher; and (iii) actuating means for moving said fabric pinchers between an open position in which an unobstructed open space is formed between the opposed gripping surfaces of said fabric pinchers and a closed position in which the fabric layer is clamped between the opposed gripping surfaces; and wherein said contact surface of said fabric pinchers is textured to provide a non-penetrating engagement with the fabric layer so that a fold is produced in the fabric layer when said fabric pinchers are moved to the closed position which extends into the open space between said pinchers and wherein the fold in the fabric layer is gripped between said opposed gripping surfaces wherein said pick-up head is mounted for vertical movement relative to said support surface to lift the upper layer of said sleeve; and (c) means for effecting relative movement between said holding fixture and said sleeve opener to insert the cuff into the sleeve.

8. The apparatus according to claim 7, wherein said holding fixture includes a pair of support fingers insertable into the cuff for positioning the cuff in a generally open configuration.

9. The apparatus according to claim 8, wherein said support fingers are movable relative to one another between a closed position to facilitate insertion of said fingers into the cuff and an open position to spread open the cuff.

10. The apparatus according to claim 9, wherein said support fingers include gripping means for gripping the cuff to hold said cuff on said support fingers.

11. The apparatus according to claim 10, wherein said gripping means comprises first and second cylindrical portions movable relative to one another between an open position in which an open space is formed between said first and second cylindrical portions, and a closed position in which the cuff is clamped between said first and second cylindrical portions.

12. The apparatus according to claim 7, wherein said contact surface of each of said fabric pinchers is embedded with diamonds to provide a non-penetrating texture for engaging the fabric layer.

13. A method for inserting a cuff into the sleeve of a garment, said method comprising the steps of:

(a) positioning the cuff in a generally open configuration in a holding fixture;

(b) opening the sleeve of a garment sufficient to allow insertion of the cuff into the sleeve by a sleeve opener, said sleeve opener including a support surface with means for holding a lower edge of the sleeve against said support surface and a pick-up head for engaging an upper layer of said sleeve, wherein said pick-up head is mounted for vertical movement relative to said support surface to lift the upper layer of said sleeve; and (c) effecting relative movement between said holding fixture and said sleeve opener to insert the cuff into the sleeve.

14. A method for inserting a cuff into a sleeve of a garment, said method comprising the steps of:

(a) positioning the cuff in a generally open configuration in a holding fixture;

(b) opening the sleeve of a garment sufficient to allow insertion of the cuff into the sleeve by a sleeve opener, said sleeve opener including a support surface for supporting said sleeve, said support surface including a plurality of vacuum ports connected to a vacuum source for holding a lower layer of said sleeve against said support surface and a pick-up head for engaging an upper layer of said sleeve, said pick-up head including: (i) a frame mounted for vertical movement between a raised position and a lowered position; (ii) at least one pair of opposed fabric pinchers extending downwardly from said frame, each fabric pincher including a contact surface for engaging the fabric layer when said frame is moved to a lowered position and a gripping surface opposed by the gripping surface of said opposing pincher; and (iii) actuating means for moving said fabric pinchers between an open position in which an unobstructed open space is formed between the opposed gripping surfaces of said fabric pinchers and a closed position in which the fabric layer is clamped between the opposed gripping surfaces; and wherein said contact surface of said fabric pinchers is textured to provide a non-penetrating engagement with the fabric layer so that a fold is produced in the fabric layer when said fabric pinchers are moved to the closed position which extends into the open space between said pinchers and wherein the fold in the fabric layer is gripped between said opposed gripping surfaces wherein said pick up head is mounted for vertical movement relative to said support surface to lift the upper layer of said sleeve; and (c) effecting relative movement between said holding fixture and said sleeve opener to insert the cuff into the sleeve.

* * * * *